US006782936B1

(12) United States Patent
Girard et al.

(10) Patent No.: US 6,782,936 B1
(45) Date of Patent: Aug. 31, 2004

(54) AWNING SYSTEM FOR A RECREATIONAL VEHICLE

(75) Inventors: Larry Girard, Dana Point, CA (US); Howard Jelinek, Laguna Beach, CA (US)

(73) Assignee: Girard Systems, Inc., Irvine, CA (US)

( * ) Notice: Subject to any disclaimer, the term of this patent is extended or adjusted under 35 U.S.C. 154(b) by 0 days.

(21) Appl. No.: 10/366,952

(22) Filed: Feb. 14, 2003

(51) Int. Cl.[7] ..... E04F 10/00

(52) U.S. Cl. ..... 160/66; 160/22; 160/67; 135/89; 296/163

(58) Field of Search ..... 160/66, 67, 68, 160/69, 70, 22; 135/89; 296/163

(56) References Cited

U.S. PATENT DOCUMENTS 4,160,458 A * 7/1979 Marcellus
4,164,972 A * 8/1979 Bennett
4,180,117 A * 12/1979 Greer
4,508,126 A * 4/1985 Everard ..... 160/67
4,615,371 A 10/1986 Clauss
4,862,940 A * 9/1989 Atchison
4,941,524 A * 7/1990 Greer
5,038,087 A * 8/1991 Archer et al. ..... 318/469
5,044,416 A * 9/1991 Murray
5,171,056 A * 12/1992 Faludy et al.
5,192,111 A * 3/1993 Hanemaayer
5,232,036 A * 8/1993 Brutsaert
5,307,856 A * 5/1994 Murray
5,351,736 A * 10/1994 Laffler et al.
5,407,007 A * 4/1995 Lowrey
5,860,440 A * 1/1999 Murray et al.
6,142,209 A * 11/2000 Girard
2001/0027846 A1 * 10/2001 Osinga
2002/0007921 A1 * 1/2002 Dieckmann ..... 160/66
2003/0019588 A1 * 1/2003 Schmitz ..... 160/66
2003/0201073 A1 * 10/2003 Dieckmann ..... 160/66

FOREIGN PATENT DOCUMENTS

DE 3146169 * 5/1983 ..... 160/66 X

* cited by examiner

*Primary Examiner*—Bruce A. Lev
(74) *Attorney, Agent, or Firm*—Walter A. Hackler

(57) ABSTRACT

An automatic lateral arm awning system for a recreational vehicle includes awning material having a first and a second end, a roller secured to the material first end for wrapping said awning material thereabout and a header secured to the material second end. A frame is provided for enclosing the roller and awning material and sealing with the header in order to prevent wind-generated noise upon driving of the recreational vehicle. A pair of spring loaded arms interconnecting the frame and said header for urge the header away from the frame upon rotation of the roller in one direction and an electric motor, disposed within the roller, rotates the roller. The awning material unrolls from the roller and extends outwardly from the frame upon rotation of the roller in the one direction and wraps around said roller upon rotation of the roller in an opposite direction. Awning material stretch is accommodated in order to insure sealing between said header and said frame.

4 Claims, 4 Drawing Sheets

AWNING SYSTEM FOR A RECREATIONAL VEHICLE

The present invention generally relates to self-storing awning assemblies for recreational vehicles and is more particularly directed to boxed awnings, including lateral arm support awnings, which include a roller for automatically retracting a awning into the box, or frame.

When closed, it is necessary that the box containing an awning be sealed in order to prevent undesirable wind noise during operation of the vehicle. It should be appreciated that if the awning is not contained in the box or frame in a sealed manner, any gaps occurring will act as an annoying source of sound when air rushes past at speeds up to 70 mph. Further, undo stress may be induced due to such wind buffeting thus being a source of potential damage.

When new, such sealed awning boxes function properly, however, during usage, the awning material typically stretches, which causes a problem with regard to the system for extending and retracting the awning. Typical fabric stretch amounts to 2–3% of fabric length, or more, and this relates to up to 3 inches or more for a 10 foot awning.

This problem is set forth in U.S. Pat. No. 4,615,373. When the awning stretches, typical control systems cannot accommodate for the extra length of awning and consequently, the retraction of the awning is stopped before the awning is entirely within the box or frame and sealed therein to prevent any gaps.

U.S. Pat. No. 4,615,371 provides for adjustment of limit switches so that a drive motor does not need to be shut off prematurely.

Other systems include counters, or stepper motors, for controlling the start and stop positions of the awning relative to the box during the extension and retraction. These systems are not amenable to accommodating for awning stretch.

The present invention provides for an automatic lateral arm awning system for recreational vehicle which accommodates for awning material stretch in order to insure sealing of the awning within a frame in order to prevent wind generated noise during movement of the recreational vehicle.

SUMMARY OF THE INVENTION

An automatic lateral arm awning system for a recreational vehicle in accordance with the present invention generally includes awning material having a first and a second end with a roller secured to the material first end for wrapping the awning material thereabout.

A header is provided and secured to the material second end and a frame is provided for enclosing the roller and awning material and sealing with the header in order to prevent wind generated noise upon driving of the recreational vehicle.

Arms interconnect the frame and the header and may be spring loaded for urging the header away from the frame upon rotation of the roller in one direction and an electric motor disposed within the roller is provided for rotating the roller. The awning material unrolls from the roller and extends outwardly from the frame upon rotation of the roller in one direction and wraps around the roller upon rotation of the roller in an opposite direction.

Importantly, means are provided for accommodating for awning material stretch in order to insure sealing between the header and the frame. This means includes a control circuit for determining motor current and stopping the electric motor upon an increase in motor current greater than an operating current for rotation of the roller in the opposite direction.

The control circuit may be configured for shutting off current to the electric motor upon stalling of the electric motor or upon a preset increase in current draw. That is, the motor control circuit determines the current during operation of the electric motor and stops rotation of the roller upon sealing of the header with the frame.

A method in accordance with the present invention for an automatic lateral arm awning system for recreational vehicle generally includes the steps of providing awning material having a first and second end, securing a roller to the material first end for wrapping around the awning material and securing a header to the material second end.

Method further provides for enclosing the roller and awning material with a frame and sealing the frame with the header in order to prevent wind generated noise upon driving of the recreational vehicle.

The frame and the header may be interconnected by a pair of spring-loaded arms for urging the header away from the frame upon rotation of the roller in one direction. The method further includes disposing an electric motor within the roller for rotating the roller.

In one embodiment, the method still further provides for accommodating for awning material stretch in order to insure sealing between the header and the frame by determining motor current and stopping the electrical motor upon an increase in motor current greater than an operating current for rotation of the roller and during retraction of the awning.

More particularly, the step of determining motor current may include waiting for a period of time until the motor reaches a steady state running speed and thereafter sampling the motor current after the waiting period. Alternatively, the step of stopping the electric motor may include stopping the motor upon stalling thereof due to increase loading during a sealing between the header and the frame.

BRIEF DESCRIPTION OF THE DRAWINGS

A more complete understanding of the invention may be had by reference to the following detailed description when taken in conjunction with the accompanying drawings, in which.

DETAILED DESCRIPTION

Figure 1:
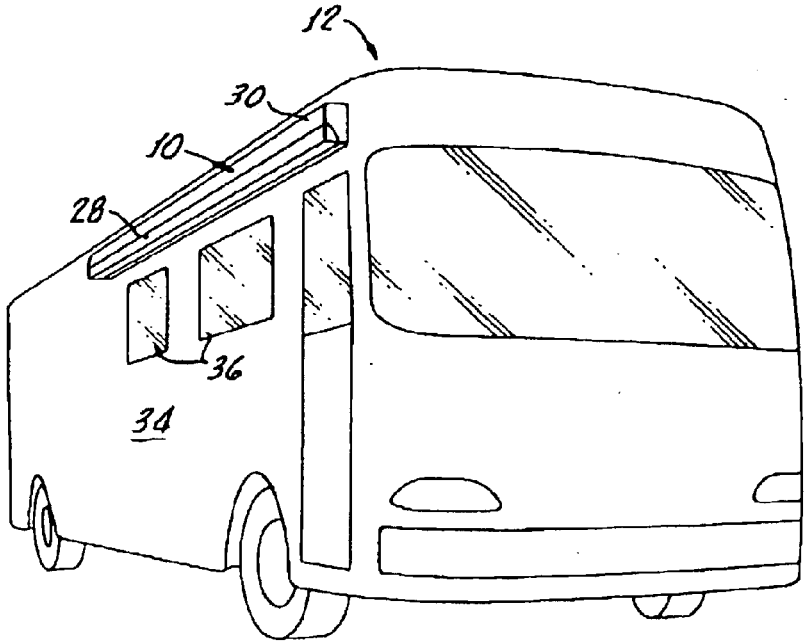
FIG. 1 is a perspective view of the awning system in accordance with the present invention as shown in a closed position with an awning frame and header shown in a sealed arrangement in order to prevent wind-generated noise.
Figure 2:
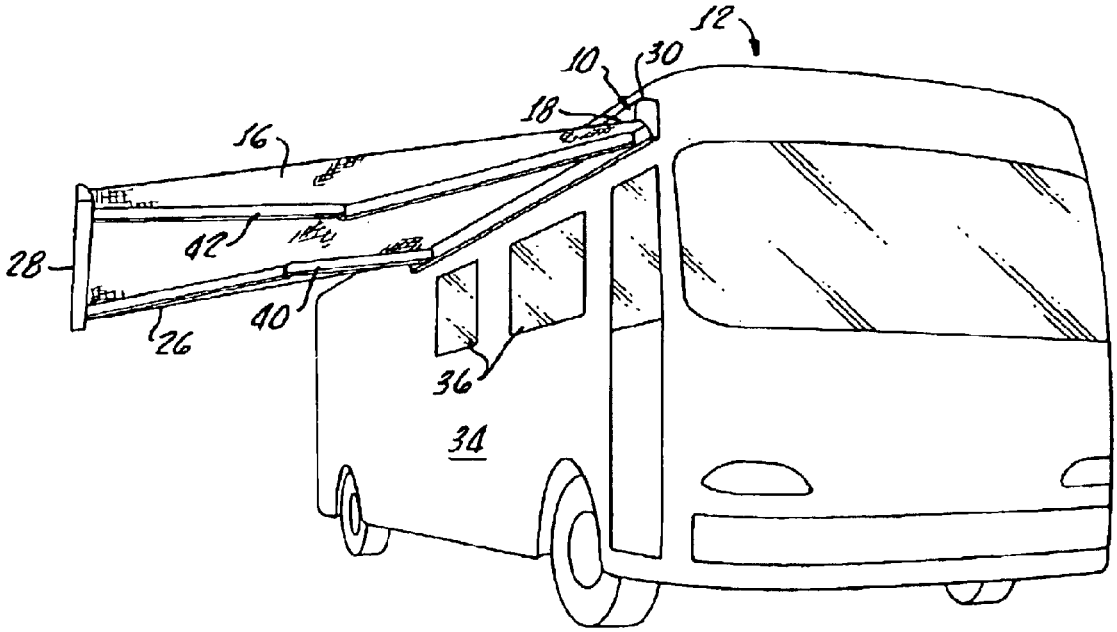
FIG. 2 is a perspective view of the awning system as shown in FIG. 1 in an extended position.
Figure 3:
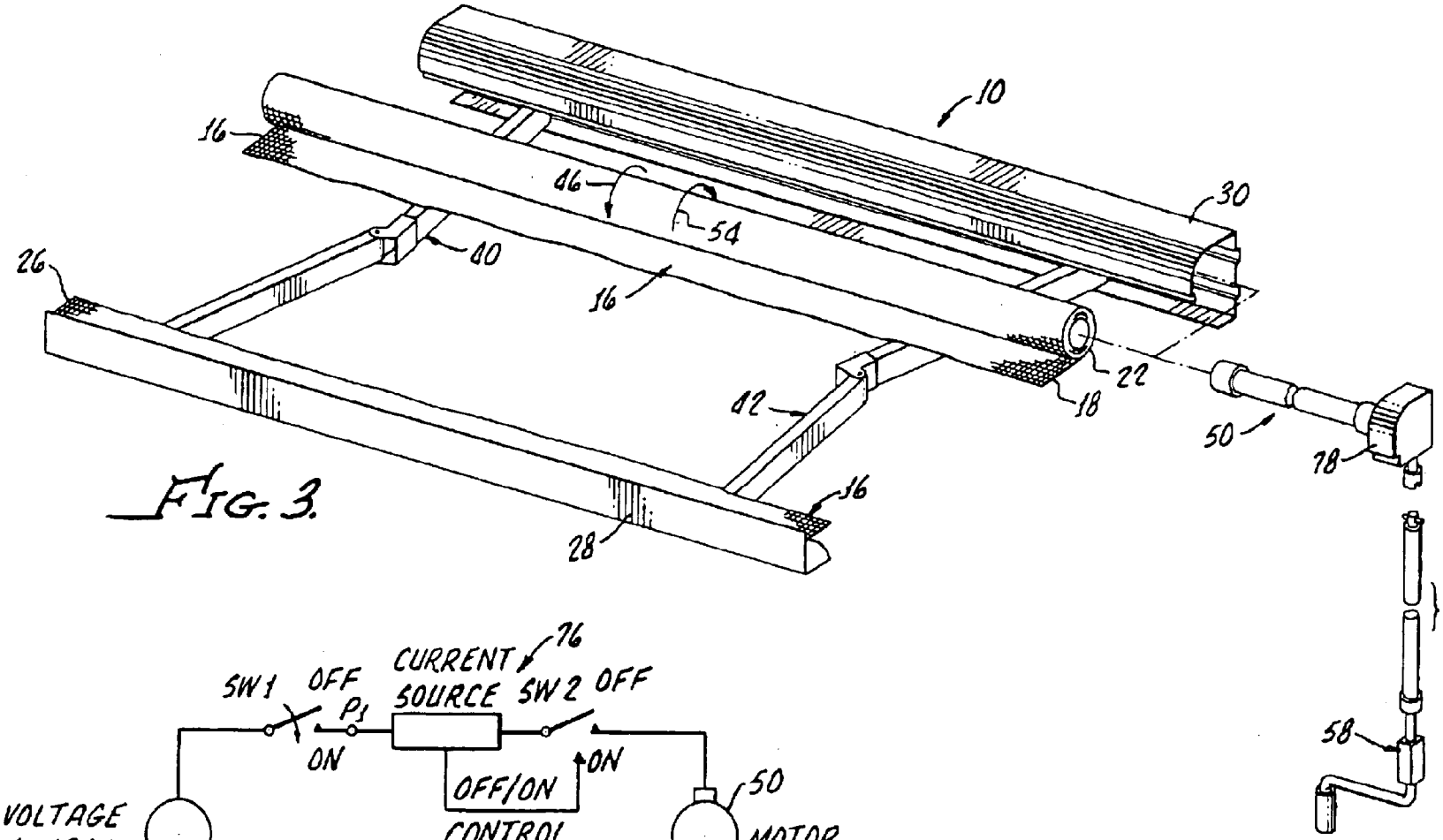
FIG. 3 is an exploded view of the awning system in accordance with the present invention.

With reference to FIGS. 1–3, there is shown an automatic lateral arm awning system 10 for a recreational vehicle 12 which generally includes any suitable awning material 16 having a first end 18 secured to a roller (See FIG. 3) and a second end 26 secured to a header 28.

A frame 30 is provided for enclosing the roller 22, and awning material 16 wrapped thereabout, and sealing with the header 28, as shown in FIG. 1, in order to prevent a wind generated noise upon driving of the vehicle 12.

The frame 30 may be secured to an outside wall 34 or roof of the vehicle 12 or in a conventional manner over a window 36 or, alternatively along an entire length (not shown) of the recreational vehicle 12. At least a pair of spring loaded arms 40, 42 are provided and interconnect the frame 30 and header 26 in a conventional manner for urging the header 28 away from the frame 30 upon rotation of the roller in one direction as indicated by the arrow 46 in FIG. 3 by an electric motor 50 disposed within the roller 22. Upon rotation of the roller 22 in the direction of the arrow 46, the awning material 16 unrolls from the roller 22 and extends outwardly from the frame 30. Conversely, when the motor 50 rotates the roller 22 in the direction of the arrow 54, the awning material 16 is wrapped around the roller 22. A hand crank 58 may also be provided as an emergency means for rotating the roller 22 in the case of a power outage, as is conventional.

Figure 4:
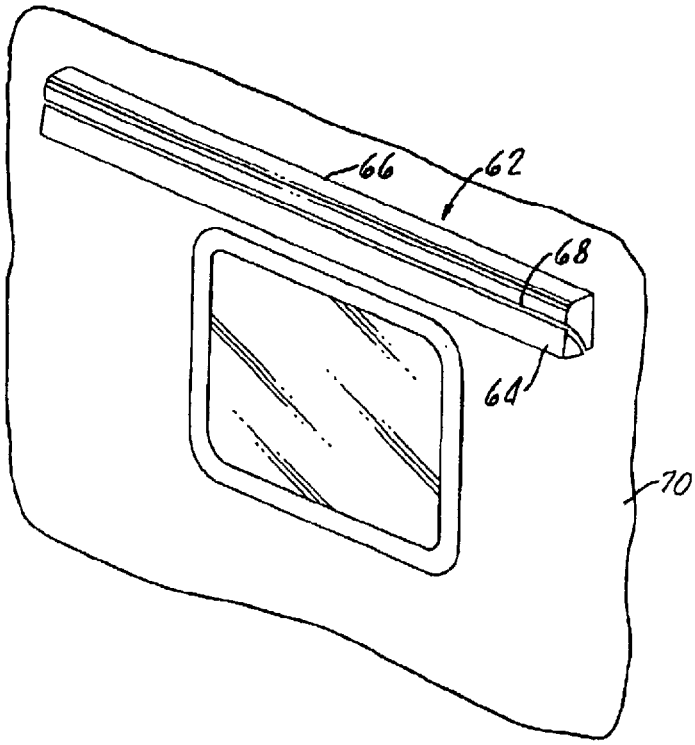
FIG. 4. (PRIOR ART)
FIG. 4 is a perspective view of a prior art awning system which provides no accommodation for awning stretch during closure, thus not providing an adequate seal between a header and a frame in order to prevent wind generated noise.

Unfortunately, over time, the awning material 16 stretches. In doing so, the length of the extended awning between the frame 30 and the header 28 increases. As hereinabove noted, this increase can be up to 3 inches or more. This increase length is not accommodated by prior art systems 62, see FIG. 4 shown mounted on a vehicle 70. That is, in the prior art system 62 the header 64 does not fully close against the frame 66 due to control limitations on a retracting motor (not shown), resulting in a gap 68 between the frame 66 and the header 64, which generates unwanted wind noise during movement of the recreational vehicle 12, particularly at high speeds, i.e., above 50 miles per hour. This gap 68 may be up to about 3 inches for a 10-foot awning extension from the vehicle 12 with only between 2 to 3 percent of fabric length along the extension.

Figure 5:
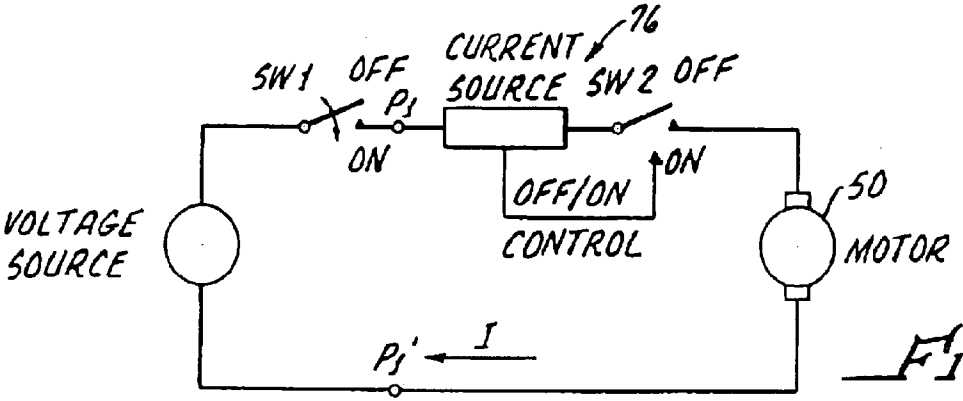
FIG. 5 is a functional design of a canted circuit for determining motor current and stopping the electric motor; key elements are an external switch, power, current sensor (device for measuring current), an adaptor current measurement and central circuit, and a relay controlled by the micro controller.
Figure 6:
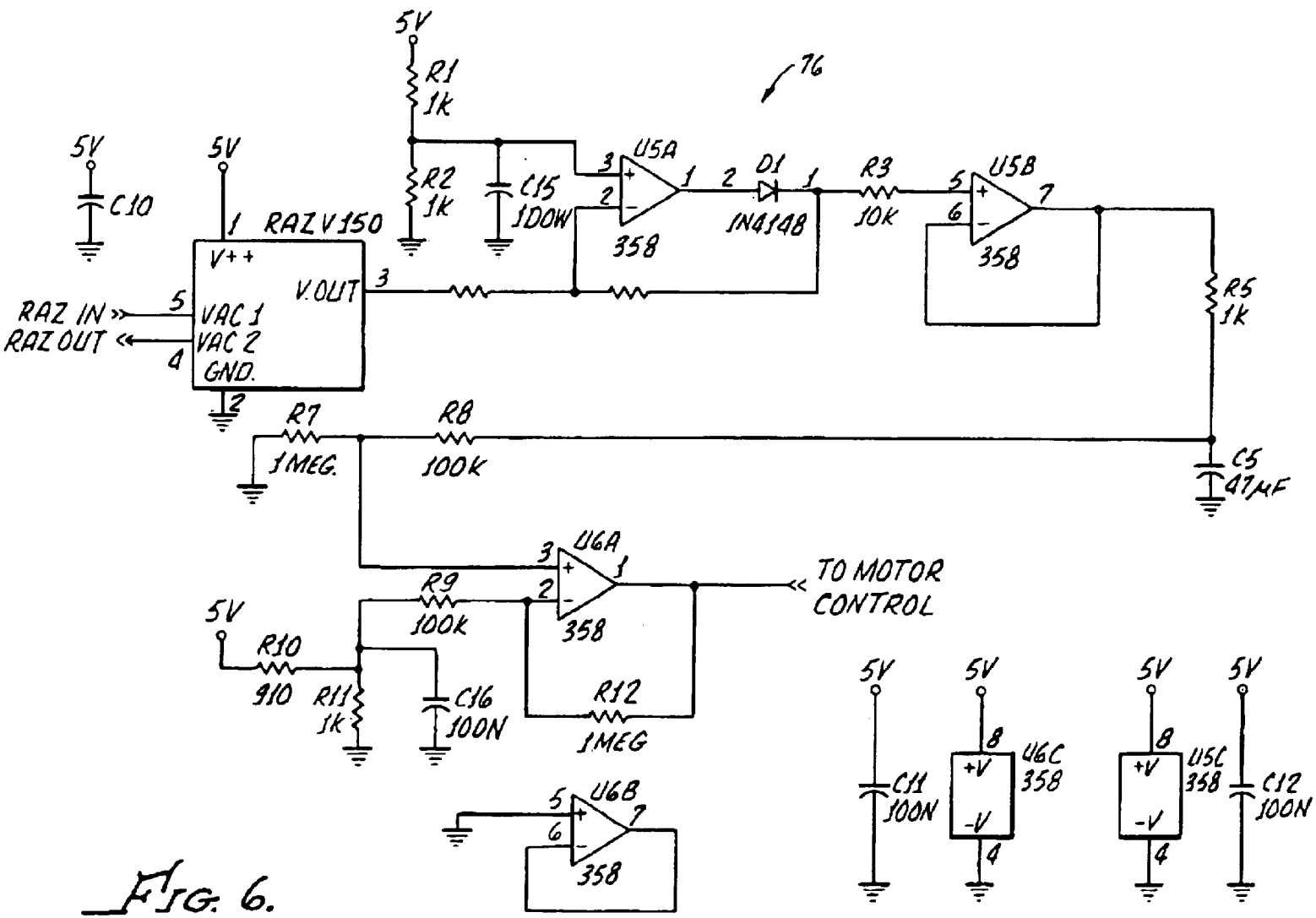
FIG. 6 is a schematic diagram of a control circuit for determining motor current and stopping the electric motor.

The present invention provides for an electric motor control circuit 76, shown in a functional design in FIG. 5 and schematic form in FIG. 6, which is preferably disposed within a motor housing 78, see FIG. 3. The circuit 76 is effective for determining motor current during operation of the electric motor 50 and stopping rotation of the roller 22 upon sealing of the header 28 with the frame 30. Thus, the circuit provides a means for accommodating for an awning material stretch in order to insure sealing between the header 28 and the frame 30.

Figure 7:
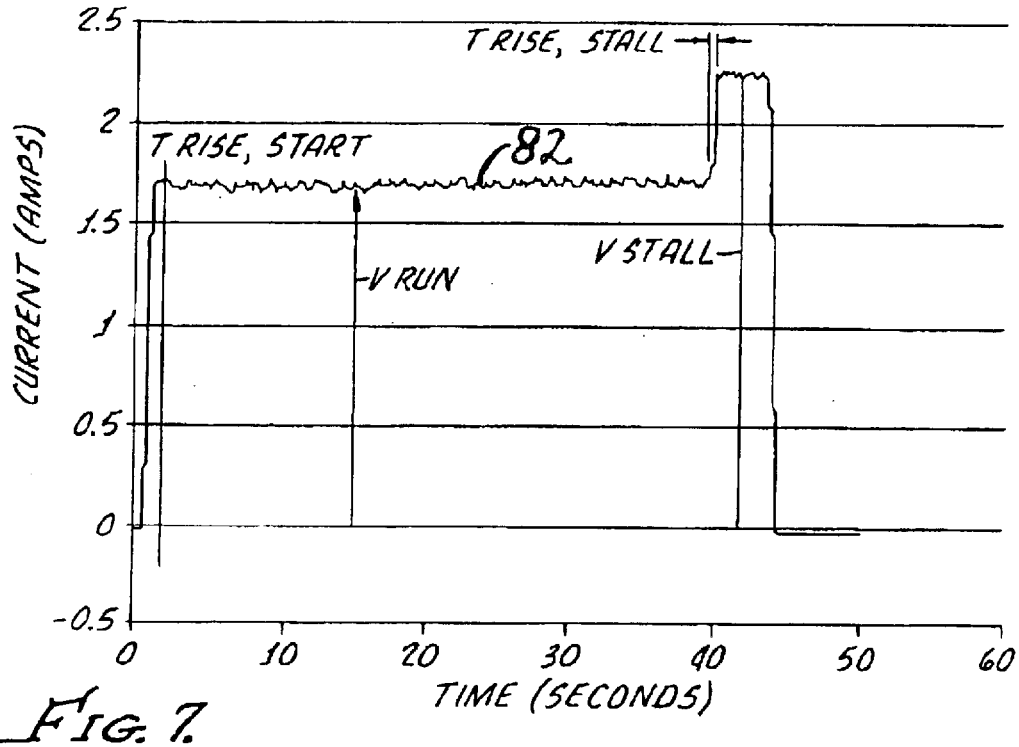
FIG. 7 is a plot of electric motor current versus time during operation while retracting an awning.

The electrical current characteristics of the motor 50 for the system 10, which may be varying in length between 8–21 feet is shown in FIG. 7. The actual current draw is a function of motor load profile, motor rating, and voltage source supply. However, the current draw profiles during operation similar are regardless of the parameters. As shown upon start up, the current as illustrated by the line 82 in FIG. 7 jumps and then maintains a relatively steady state current draw during retraction of the awning material 16 until closure, or sealing, between the header 28 and the frame 30, at which time a rapid increase in current illustrated by the line segment 84.

A circuit 76 detects the increase in motor current greater than the operating current 82 for rotation of the roller 22 and stops the motor 50 by turning off the current thereto.

Alternatively, the circuit may detect a stalling of the motor 50 adaptively by sensoring substantial increase in current indicated by the segment 88 and turn off power to the motor 50. That is, when the awning material 16 has been fully retracted the motor 50 stalls resulting in a rapidly increasing current draw illustrated by the line 88. The circuit 76 acts as a current slope detector, looking for the change in current, which may use a RAZtec B150 Hall effect sensor. Once the change in current change over time has been detected, a relay is opened breaking the path to the motor.

Preferably, the circuit 76 acts as a three state processor, namely start up, sample and stop motor 50. During the start up state, the circuit 76 waits in the order of one second before sampling the current. This allows the motor 50 to reach a steady state running speed indicated by the line 82 and insures that the circuit 76 will not trip on the start up current. During the sample state, the circuit 76 samples the current and runs an algorithm to determine that the stalled state has been reach. If the motor is stalled, the processor circuit 76 opens a relay and stops the motor 50. The relay remains open unless the awning is extended and then retracted.

The circuit 76, after start, samples the current every millisecond. Several samples are averaged to form one short term average. The average rise time for the stall current is between 100–250 milliseconds and the difference between the run current and the stall current ranges from 25% to 55% depending upon the motor, low and supply voltage.

Although there has been hereinabove described a specific awning system for a recreational vehicle in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element, which is not specifically disclose herein. Accordingly, any and all modifications, variations or equivalent arrangements which may occur to those skilled in the art, should be considered to be within the scope of the present invention as defined in the appended claims.

What is claimed is:

1. An automatic lateral arm awning system for a recreational vehicle, the system comprising:

awning material having a first and a second end;

a roller secured to the material first end for wrapping said awning material thereabout;

a header secured to the material second end;

a frame for enclosing said roller and awning material and sealing with said header in order to prevent wind generated noise upon driving of said recreational vehicle;

an electric motor disposed within said roller for rotating said roller without the use of a counter for determining a number of roller rotations, said awning material unrolling from said roller and extending outwardly from said frame upon rotation of the roller in said one direction and wrapping around said roller upon rotation of the roller in an opposite direction; and means for accommodating for awning material stretch in order to insure sealing between said header and said frame, said means for accommodating awning stretch including a control circuit configured for sampling motor current after start and during steady state running speed, calculating a short term current average, and stopping the motor wherein the motor current exceed the calculated current average by between 25% and 55%.

2. An automatic lateral arm awning system for a recreational vehicle, the system comprising:

awning material having a first and a second end;

a roller secured to the material first end for wrapping said awning material thereabout;

a header secured to the material second end;

a frame for enclosing said roller and awning material and sealing with said header in order to prevent wind generated noise upon driving of said recreational vehicle;

a pair of spring loaded arms interconnecting said frame and said header for urging said header away from said frame upon rotation of said roller in one direction;

an electric motor disposed within said roller for rotating said roller without the use of a counter for determining a number of roller rotations, said awning material unrolling from said roller and extending outwardly from said frame upon rotation of the roller in said one direction and wrapping around said roller upon rotation of the roller in an opposite direction; and means for accommodating for awning material stretch in order to insure sealing between said header and said frame, said means for accommodating including a control circuit for determining motor current and stopping said electric motor upon an increase in motor current greater than an operating current for rotation of said roller in the opposite direction.

3. A method for operating an automatic lateral arm awning system for a recreational vehicle, the method comprising:

providing awning material having a first and a second end;

securing a roller to the material first end for wrapping said awning material thereabout;

securing header to the material second end;

enclosing said roller and awning material with a frame;

sealing said frame with said header in order to prevent wind generated noise upon driving of said recreational vehicle;

interconnecting said frame and said header with a pair of spring loaded arms for urging said header away from said frame upon rotation of said roller in one direction;

disposing an electric motor within said roller for rotating said roller without the use of a counter for determining a number of roller rotations, said awning material unrolling from said roller and extending outwardly from said frame upon rotation of the roller in said one direction and wrapping around said roller upon rotation of the roller in an opposite direction; and accommodating for awning material stretch in order to insure sealing between said header and said frame, the step of accommodations including sampling motor current after start up and during steady state running speed, calculations and short term current average and stopping the motor when the motor current exceeds the calculating current average by between 25% and 55%.

4. The method according to claim 3 wherein the step of accommodating for awning material stretch includes determining motor current and stopping said electric motor upon an increase in motor current greater than an operating current for rotation of said roller in the opposite direction.

* * * * *